US008193727B2

(12) United States Patent
Hamana et al.

(10) Patent No.: US 8,193,727 B2
(45) Date of Patent: Jun. 5, 2012

(54) LAMP END OF LIFE PROTECTION CIRCUIT AND METHOD FOR AN ELECTRONIC DIMMING BALLAST

(75) Inventors: Tetsuya Hamana, Nara (JP); Hiroyuki Asano, Nara (JP); Masafumi Yamamoto, Osaka (JP)

(73) Assignee: Panasonic Corporation, Osaka (JP)

( * ) Notice: Subject to any disclaimer, the term of this patent is extended or adjusted under 35 U.S.C. 154(b) by 412 days.

(21) Appl. No.: 12/492,013

(22) Filed: Jun. 25, 2009

(65) Prior Publication Data

US 2010/0001650 A1 Jan. 7, 2010

(30) Foreign Application Priority Data

Jun. 25, 2008 (JP) ..... 2008-166220

(51) Int. Cl.
*H05B 41/36* (2006.01)

(52) U.S. Cl. ..... 315/291; 315/224; 315/287

(58) Field of Classification Search ..... 315/119, 315/127, 128, 250, 287, 224, 291, 307
See application file for complete search history.

(56) References Cited

U.S. PATENT DOCUMENTS

| | | | | |
|---|---|---|---|---|
| 2005/0168175 | A1* | 8/2005 | Radzinski et al. | 315/307 |
| 2007/0241693 | A1* | 10/2007 | Chan et al. | 315/291 |
| 2008/0042588 | A1* | 2/2008 | Chan et al. | 315/224 |
| 2010/0096995 | A1* | 4/2010 | Kishimoto | 315/119 |
| 2011/0006699 | A1* | 1/2011 | Nerone | 315/250 |

FOREIGN PATENT DOCUMENTS

JP 2007172933 7/2007

* cited by examiner

*Primary Examiner* — Don Le
(74) *Attorney, Agent, or Firm* — Waddey & Patterson, P.C.; Mark J. Patterson

(57) ABSTRACT

A electronic ballast includes an inverter circuit for converting a DC voltage into a high-frequency voltage, a resonant circuit connected between outputs of the inverter circuit so as to light a discharge lamp by a resonant action, a control circuit for controlling the inverter circuit, a dimming circuit for continuously changing an output voltage to the discharge lamp by changing an operation frequency in the inverter circuit, a DC component detection circuit and a voltage comparator for detecting whether or not the discharge lamp is at the end of the life at predetermined intervals and outputting an end of life detection signal upon detection of the end of the life state, and a frequency control circuit and a driving circuit for reducing or stopping an output to the discharge lamp by controlling switching elements in response to a life end detection signal inputted from the voltage comparator.

2 Claims, 6 Drawing Sheets

LAMP END OF LIFE PROTECTION CIRCUIT AND METHOD FOR AN ELECTRONIC DIMMING BALLAST

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is hereby incorporated by reference: Japanese Patent Application No. JP2008-166220 filed Jun. 25, 2008.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to electronic ballasts for discharge lamps and lamp fixtures.

Electronic ballasts with dimming functionality are well known in the art. (See, e.g. Japanese Unexamined Patent Publication No. 2007-172933). FIG. 6 is a circuit diagram of a conventional electronic ballast. In this example, the ballast includes a half-bridge inverter circuit 1 having two switching elements Q1 and Q2, wherein a series circuit including the switching elements Q1 and Q2 is connected between both ends of a DC power source Vdc. A series resonant circuit 2 including an inductor T1 and a capacitor C1 is connected between a connection point of the switching elements Q1 and Q2 and a ground GND of the DC power source Vdc. The ballast is coupled to a discharge lamp FL across resonant capacitor C1 and through capacitor C2 which is used for resonant and DC blocking. Lamp filament F1 is connected to a preheating circuit 3 having a series circuit including an inductor L1 and a capacitor C3 as well as a preheating source n1. A second lamp filament F2 is connected to a second preheating circuit 3 also having a series circuit including an inductor L2 and a capacitor C4 as well as a preheating source n2. Preferably preheating sources n1 and n2 are set to have a same operation frequency.

In this conventional embodiment, a dimming signal inputted from dimming control 8 causes a frequency control circuit 5 to determine an operation frequency in the switching elements Q1 and Q2. The switching elements Q1 and Q2 are turned on/off alternately by a driving circuit 6 using a determined operation frequency. The switching elements Q1 and Q2 are turned on/off alternately to convert a DC voltage from the DC power source Vdc into a high-frequency voltage. An alternating current is made to flow in the discharge lamp FL to operate the discharge lamp FL at high frequency. The resonant circuit 2 including the inductor T1 and the capacitors C1 and C2 is connected to a power supply path to the discharge lamp FL. Energy supplied to the discharge lamp FL can be adjusted by a relationship between an operation frequency of the switching elements Q1 and Q2 and a resonant frequency of the resonant circuit 2.

A DC component detector 7 is connected in parallel to the discharge lamp FL which outputs to voltage comparator EL an output signal corresponding to a positive or negative DC voltage component generated in the discharge lamp FL. The inverter circuit 1 continuously operates in the case where the voltage comparator EL outputs a low signal. The output from the inverter circuit 1 is reduced or stopped by controlling an operation frequency in the switching elements Q1 and Q2 in the case where the voltage comparator EL outputs a high signal.

If one filament F1 or F2 is brought into a half-wave discharge state (commonly called as an emission-less state) due to consumption of an emitter (i.e. electron emissive material) at the end of the life of the discharge lamp FL, a DC voltage component is generated in the discharge lamp FL. In this case, the DC component detector 7 outputs an output signal corresponding to the DC voltage component. A signal from the DC component detector 7 is coupled to the voltage comparator EL which outputs a high signal in the case where the value of the inputted signal exceeds a reference voltage value Vref. This reduces or stops an output from the inverter circuit 1 for the purpose of lamp end of life circuit protection.

In such conventional end of life circuits, a resonant frequency in the preheating circuit 3 varies due to variations in the inductors L1 and L2 and the capacitors C3 and C4, even if the preheating sources n1 and n2 have the same operation frequency. This causes a phase difference in the constant preheating currents in the filaments F1 and F2 in accordance with changing a lamp dimming level, and creating a "hot spot" gap in the filaments F1 and F2 as a result. A hot spot position gap generated in the filaments F1 and F2 then causes a DC voltage component in a high-frequency voltage generated in the discharge lamp FL. Accordingly, a lamp end of life condition may be erroneously detected due to the DC voltage component, leaving a possibility that a protection function may be activated.

The prior art often uses the following method to avoid a false end of life detection and shutdown malfunction. When a dimming signal for changing the inverter operation frequency is inputted from the dimming control 8 to the frequency control circuit 5, a dimming signal detection circuit 9 detects a change in the dimming signal and outputs to timer 11 a signal corresponding to change in the dimming signal. In response to a signal inputted from the dimming signal detection circuit 9, the timer 11 outputs an ON signal to a driving circuit 10 so as to turn on a switch SW1 (such as transistor for example) for a predetermined period of time. Turning on the switch SW1 causes a signal from the DC component detector 7 to be fixed to a low level for a predetermined period of time.

FIG. 7 shows timing charts according to the conventional method, wherein the switch SW1 is not turned on if a dimming level is unchanged, because the dimming signal detection circuit 9 does not detect a change in the dimming signal. Therefore, a signal from the DC component detector 7 is inputted to the voltage comparator EL without making any changes, thereby allowing circuit protection for a discharge lamp FL whose life is at the end stage.

In contrast, in the case where a dimming level is rapidly changed, a DC voltage component in the discharge lamp FL is possibly inputted to the voltage comparator EL after the dimming signal stops changing, depending on a time constant of the DC component detector 7. Even in the case where a DC voltage component in the discharge lamp FL is inputted with a delay relative to a change in dimming signal, the timer 11 outputs the ON signal to the driving circuit 10 as long as the timer circuit 11 is set to have delay time which is sufficiently longer than a time constant of the DC component detector 7. This prevents an erroneous end of life detection and shutdown.

A DC voltage component occurring in changing a dimming level is observed in a rapid change in dimming level but is not observed in a gradual change thereof. In the case where a dimming level is changed as shown in the prior art (such as Japanese Unexamined Patent Publication No. 2007-172933, an operation to detect a lamp end of life condition is prohibited even when gradually changing a dimming level. This is problematic in a system with a constantly changing dimming level because the end of life end detection function may be inactive and circuit protection is impaired.

BRIEF SUMMARY OF THE INVENTION

The present invention was solves the problems of the prior art and has an object to provide an electronic ballast capable of reliably detecting discharge lamp end of life (EOL) even in changing a dimming level.

A first aspect of the present invention is characterized by including an inverter circuit having at least one switching element used to convert a DC voltage into a high-frequency voltage, a resonant circuit connected between outputs of the inverter circuit so as to cause a discharge lamp to light at high frequency by a resonant action, a preheating circuit connected to a filament of the discharge lamp in order to preheat the filament, a control circuit for controlling the inverter circuit, dimming circuitry adapted to continuously change an output voltage to the discharge lamp by changing an operation frequency in the inverter circuit, and an EOL circuit adapted to detect a lamp end of life condition and output a detection signal upon detection of a life end state, and a protection circuit adapted to reduce or stop an output to the discharge lamp by controlling the switching element in response to an life end detection signal.

A second aspect of the present invention is characterized by a lamp EOL detection circuit which outputs an end of life detection signal upon detection of the EOL condition at least twice in succession.

A third aspect of the present invention is characterized by an electronic ballast incorporating EOL detection and protection circuitry according to any one of the first and second aspects.

According to the first aspect of the present invention, whether a discharge lamp EOL condition is detected at every predetermined interval, no error detection occurs as long as a DC voltage component occurring by rapidly changing a dimming level is not observed when EOL detection occurs. This realizes a reduction in false EOL detection in comparison with the prior art which constantly detects whether a discharge lamp is at the end stage of the life. This also enables the present invention to detect lamp EOL even when changing dimming levels, so that there is more certainly in detecting lamp EOL in a lamp which constantly changes dimming level. It is also unnecessary in the present invention to use a circuit for detecting a change of a dimming signal, thereby realizing a simplification of circuit configuration.

According to the second aspect of the present invention, an EOL detection signal is outputted in the case where an EOL condition is detected multiple times in succession, thereby realizing effects of allowing more accurate EOL detection and reducing false activation of the EOL protection circuitry.

According to the third aspect of the present invention, these effects are realized in lamp fixture which is capable of detecting discharge lamp EOL even in a changing dimming level, with fewer EOL detection errors.

DETAILED DESCRIPTION OF THE INVENTION

Figure 1:
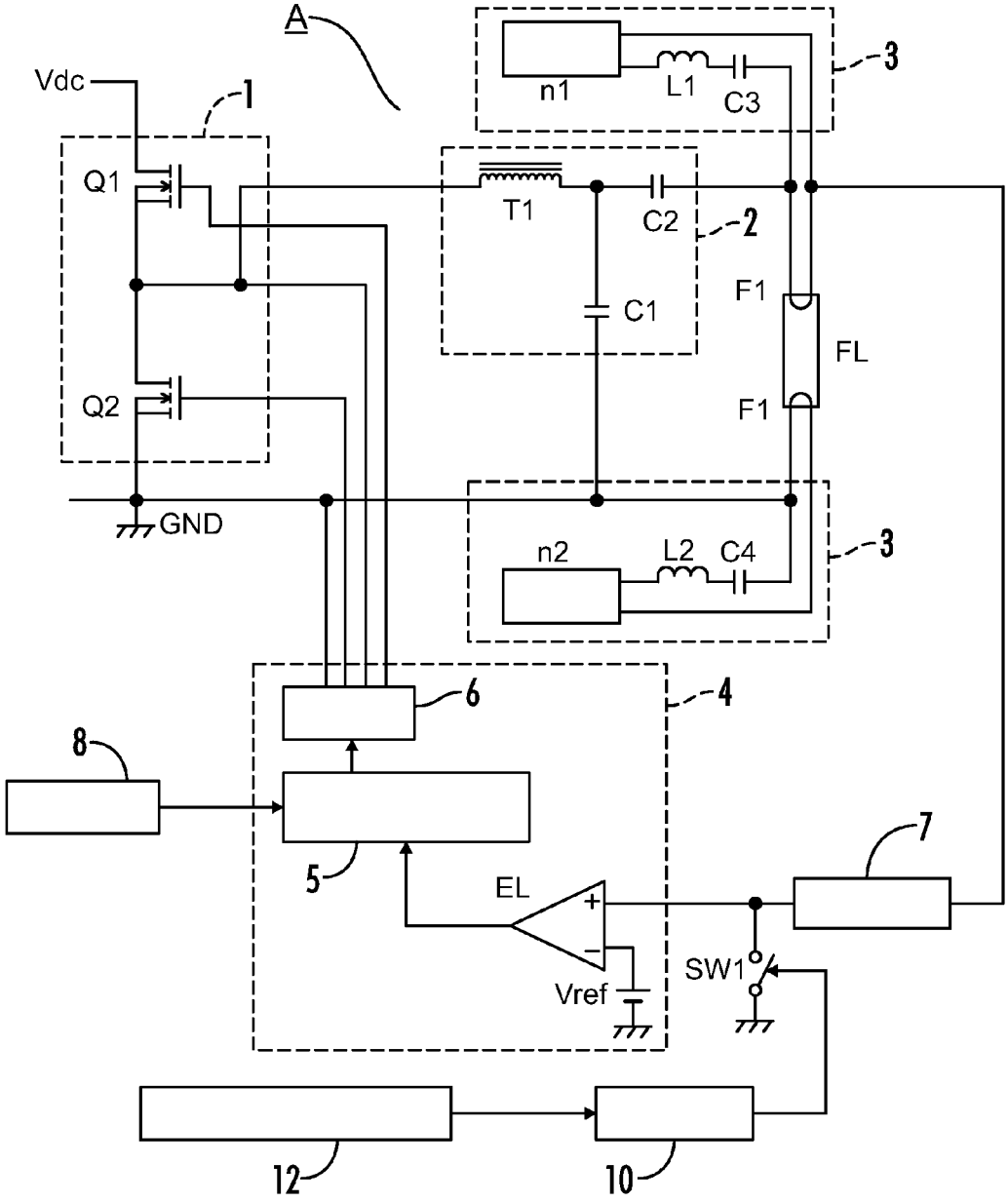
FIG. 1 is a circuit diagram showing a first embodiment of the electronic ballast of the present invention.

Embodiments of an electronic ballast for a gas discharge lamp and a lamp fixture according to the present invention will be explained with reference FIGS. 1 to 5. The ballast according to the present invention is used to light a discharge lamp at high frequency, and the lamp fixture according to the present invention is mounted onto, for example, a ceiling and used to illuminate a room FIG. 1 is a circuit diagram of an electronic ballast A according to a first embodiment, including a half-bridge inverter circuit 1 having two switching elements Q1 and Q2 series connected between the output terminals of a DC power source Vdc. A series resonant circuit 2 including an inductor T1 and a capacitor C1 is connected between a connection point of the switching elements Q1 and Q2 and a ground GND of the DC power source Vdc A discharge lamp FL is coupled to the inverter circuit 1 and across capacitor C1 via a capacitor C2 used for resonant and DC blocking. A first lamp filament F1 is connected to a preheating circuit 3 having a series circuit including an inductor L1 and a capacitor C3 as well as a preheating source n1. A second F2 is connected to a preheating circuit 3 having a series circuit including an inductor L2 and a capacitor C4 as well as a preheating source n2. The preheating sources n1 and n2 are set to have a same operation frequency in the present embodiment.

The electronic ballast A in the present embodiment has a dimming function, wherein a dimming signal inputted from a dimming control 8 (i.e. dimming means) to a frequency control circuit 5 causes the frequency control circuit 5 to determine an operation frequency in the switching elements Q1 and Q2. The switching elements Q1 and Q2 are turned on/off alternately by a driving circuit 6 using a determined operation frequency. The switching elements Q1 and Q2 are turned on/off alternately to convert a DC voltage from the DC power source Vdc into a high-frequency voltage, causing an alternating current to flow in the discharge lamp FL so as to light the discharge lamp FL at high frequency.

The resonant circuit 2 of inductor T1 and the capacitors C1 and C2 is connected to a power supply path to the discharge lamp FL. The energy supplied to the discharge lamp FL can be adjusted by a relationship between an operation frequency of the switching elements Q1 and Q2 and a resonant frequency of the resonant circuit 2.

A DC component detection circuit 7 is connected in parallel to the discharge lamp FL which outputs a lamp EOL signal to a voltage comparator EL in response to a predetermined positive or negative DC voltage component generated in the discharge lamp FL. The inverter circuit 1 continuously operates in response to a low signal outputted from the voltage comparator EL, whereas an output from the inverter circuit 1 is reduced or stopped by controlling an operation frequency in the switching elements Q1 and Q2 in response to a high signal outputted from the comparator EL. In this embodiment, the DC component detection circuit 7 and the voltage comparator EL constitute an EOL detection circuit, and the frequency control circuit 5 and the driving circuit 6 constitute an EOL protection circuit. The frequency control circuit 5, driving circuit 6 and voltage comparator EL also constitute a control circuit 4.

The electronic ballast A in the present embodiment is also configured to detect a DC voltage component at predetermined intervals or times by the DC component detection circuit 7 using a pulse signal output circuit 12, a driving circuit 10 and a switch SW1. That is, a pulse signal is outputted from the pulse signal output circuit 12 to the driving circuit 10 according to a predetermined period so as to turn on the switch SW1 by the driving circuit 10 in response to a high pulse signal, and turn off the switch SW1 by the driving circuit 10 in response to a low pulse signal. Accordingly, an output from the DC component detection circuit 7 is inputted to the voltage comparator EL only in a period in which the switch SW1 is turned off. Then, in the case where, for example, one filament F1 or F2 is brought into an emission-less state and a voltage outputted from the DC component detection circuit 7 exceeds a reference voltage Vref, the voltage is not inputted to the voltage comparator EL because the switch SW1 is turned on by the pulse signal. The inverter circuit 1 therefore continuously operates. When the voltage from DC component detection circuit 7 is inputted to the voltage comparator EL when the switch SW1 is turned off, this is followed by reducing or stopping an output from the inverter circuit 1 via the frequency control circuit 5 and the driving circuit 6.

Figure 2:
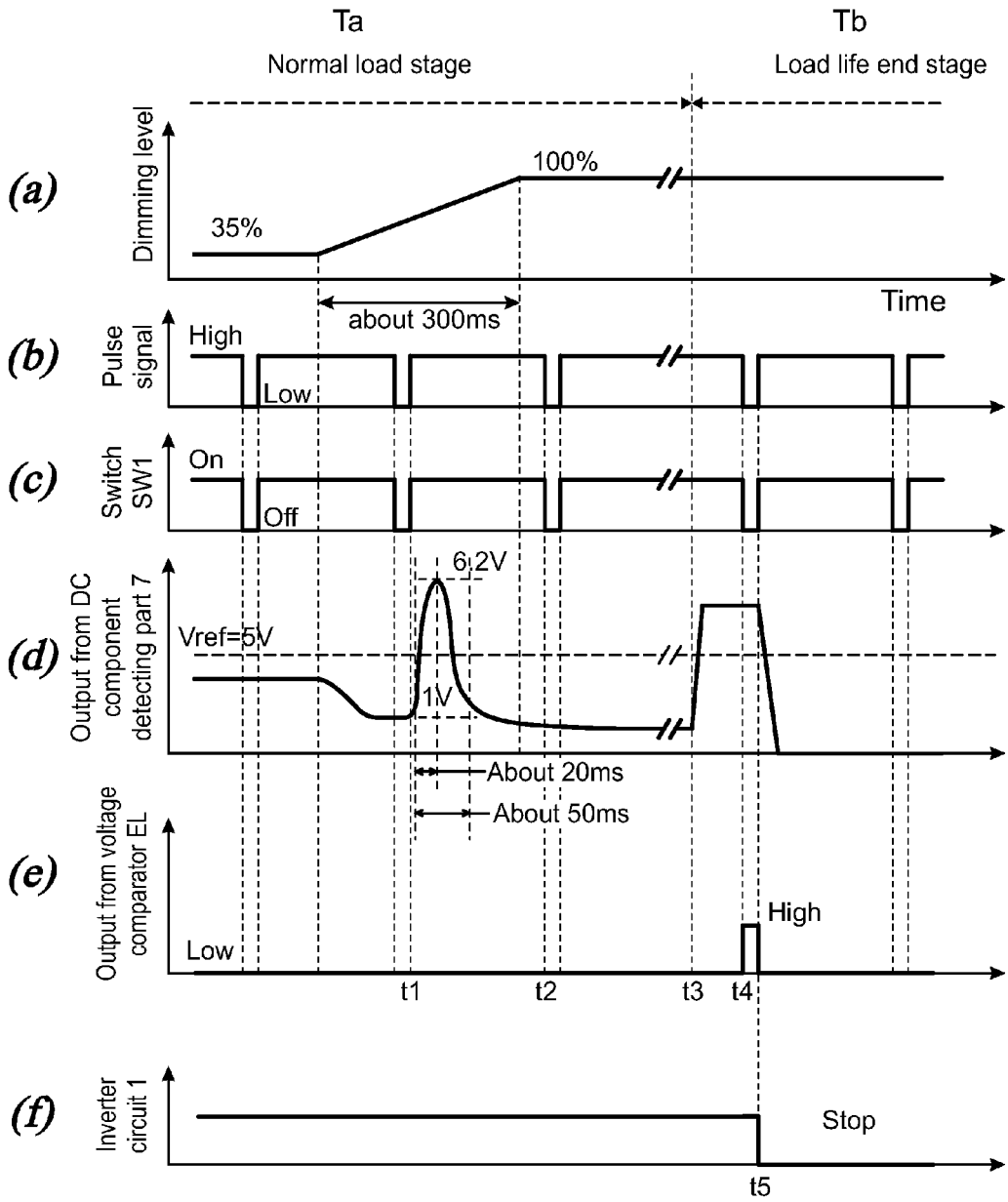
FIG. 2 is a signal timing chart according to embodiment of FIG. 1.

FIG. 2 shows an output waveform in each of the ballast sub-circuits when a dimming level is changed in a normal lamp condition (i.e. section Ta in FIG. 2) and an output waveform in each of the ballast sub-circuit circuit in a lamp EOL condition (i.e. section Tb in FIG. 2). Section (a) shows a dimming level signal, Section (b) shows a pulse signal of the pulse signal output circuit 12. Section (c) shows a switching state of switch SW1. Section (d) shows a value detected in the DC component detection circuit 7. Section (e) shows a value outputted from the voltage comparator EL, and section (f) shows an operating state of the inverter circuit 1.

Note that the present embodiment can be used with a FHF24S type for the discharge lamp FL. In this embodiment, and shown in the normal lamp state Ta in FIG. 2 is a change observed when a dimming level of the discharge lamp FL is switched by the dimming circuit 8 from a dimming state of 35% to a full lighting state (i.e. dimming level of 100%) at about 300 ms.

In the normal lamp state Ta, a DC voltage component starts to change sharply at time t1 and reaches a peak value (i.e. 6.2V) at about 200 ms, followed by returning to a normal DC voltage component level at about 50 ms. Accordingly, setting the period of a pulse signal to be longer than 50 ms allows a DC voltage component to return to a normal value at time t2 in a subsequent detection period, whereby the voltage comparator EL outputs a low signal (section (e) and the inverter circuit 1 continuously operates without a false EOL detection and shutdown (refer to section (f).

In lamp life end stage Tb, a DC voltage component exhibits a sharp change at time t3 as shown in section (d), and the voltage comparator EL outputs a high signal when a DC voltage component is detected at time t4 in a subsequent detection period, so that an output from the inverter circuit 1 is stopped at time t5 as a result.

If the period of the pulse signal is shorter than 50 ms, a DC voltage component occurring when changing a dimming level is detected and it is therefore necessary to set the period to be longer than 50 ms. But setting a too long period requires prolonged time to detect an abnormality in an emission-less state of the discharge lamp FL and causes concern for an electrical stresses applied to each circuit component. Thus, the period should be preferably set in a rage of 100 to 150 ms.

An output from the DC component detection circuit 7 is also inputted to the voltage comparator EL only when pulse signal is low. If an output value of the DC component detection circuit 7 exceeds the reference voltage Vref, an output from the inverter circuit 1 is reduced or stopped by the frequency control circuit 5 and the driving circuit 6, so that a period of time set for a low output of a pulse signal may also be short as long as it satisfies a period of time for the frequency control circuit 5 to recognize an output from the voltage comparator EL. However, if, for example, the frequency control circuit 5 is configured to monitor an output from the voltage comparator EL periodically, it is necessary to set a period of time for a low output of a pulse signal to be longer than a monitoring period.

Accordingly, the present embodiment realizes lamp EOL detection at every predetermined interval without error detection as long as a DC voltage component occurring in changing a dimming level rapidly is not observed at the time to detect the EOL condition. False EOL detection is therefore reduced in comparison with the prior art which constantly detects the EOL condition. The lamp EOL can also be detected when performing a dimming control as opposed to the prior art. This insures EOL protection even in a lamp fixture which changes dimming level constantly.

Note that the frequency control circuit 5, voltage comparator EL, driving circuit 10, pulse signal output circuit 12 and switch SW1 may be replaced with a microcontroller or microprocessor. For example, an output from the DC component detection circuit 7 can be read through an A/D converter provided in a microcontroller and a period to read the output may be set to correspond to the period of the pulse signal. A configuration may also be provided such that an output from the dimming circuit 8 is read through the A/D converter and an operation frequency in the inverter circuit 1 is changed in accordance with an output value of the dimming circuit 8.

Figure 3:
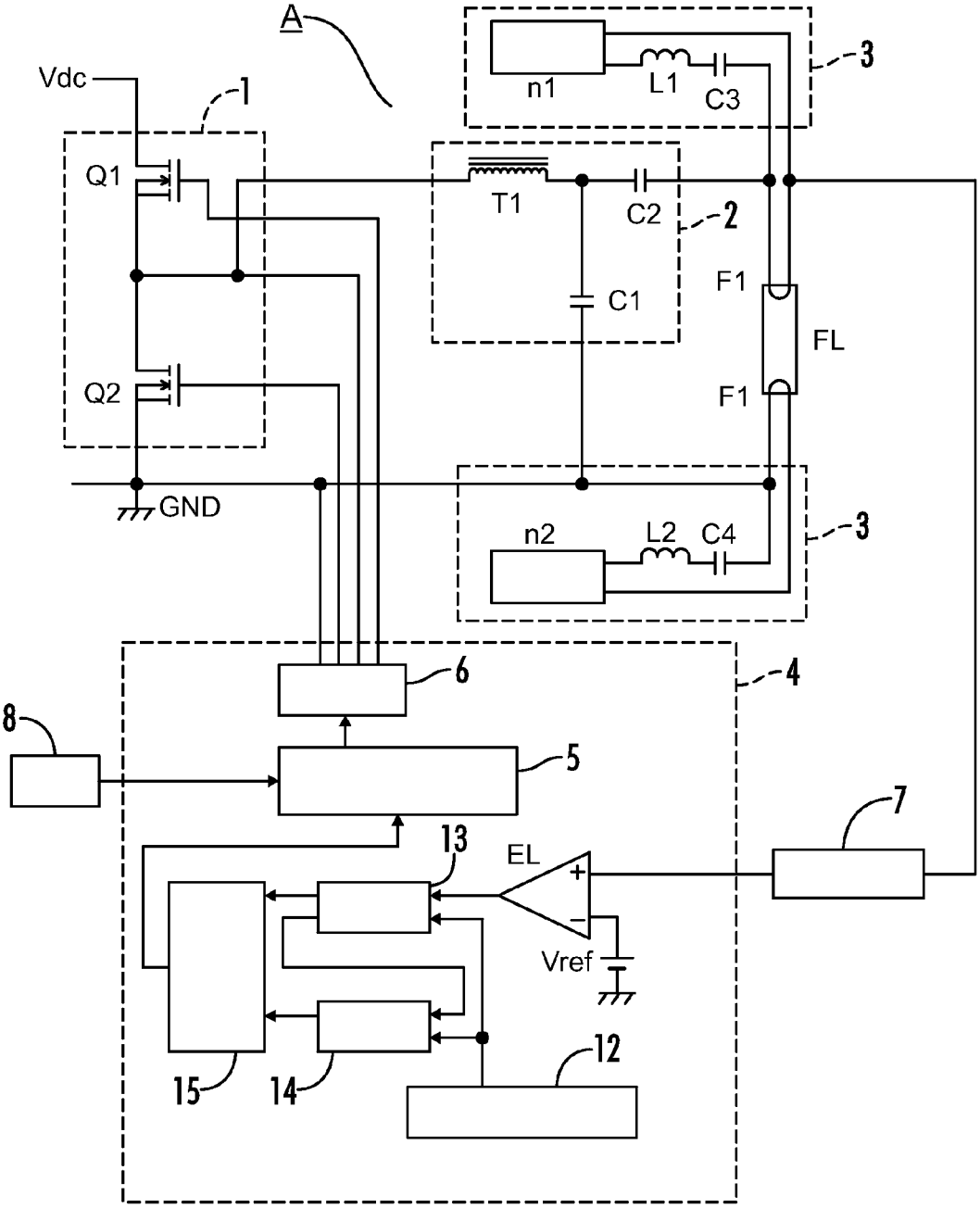
FIG. 3 is a circuit diagram showing a second embodiment of the electronic ballast of the present invention.

FIG. 3 is a circuit diagram showing an electronic ballast A according to a second embodiment. This embodiment differs from the first embodiment in that the present embodiment uses the pulse signal output circuit 12, gate circuits 13 and 14, and an AND circuit 15 to realize an output of an abnormal signal from the DC component detection circuit 7 at every predetermined period, as opposed to the first embodiment which is configured to use the pulse signal output circuit 12, the driving circuit 10 and the switch SW1 to realize an output of an abnormal signal from the DC component detection circuit 7. Note that this embodiment is otherwise similar to that of the first embodiment, and explanation thereof will be omitted by using the same reference numbers to indicate the same component elements.

The pulse signal output circuit 12 outputs a pulse signal serving as a clock with respect to each of the gate circuits 13 and 14 (such as D flip-flop for example). Note that this pulse signal is established in the same manner as in the first embodiment. The gate circuit 13 outputs to the gate circuit 14 and the AND circuit 15 and receives an output from the voltage comparator EL in when the pulse signal goes low. The gate circuit 14 similarly outputs to the AND circuit 15 and receives an output from the gate circuit 13 when the pulse signal goes low. That is, an output from the DC component detection circuit 7 is outputted to the circuits in every period of a pulse signal according to the present embodiment. The AND circuit 15 is configured so that outputs from the gate circuit 13 and the gate circuit 14 are inputted thereto, and the AND circuit 15 accordingly outputs to the frequency control circuit 5, AND-ing an output from the voltage comparator EL this time and an output from the voltage comparator EL after one period of a pulse signal. In the present embodiment, the DC component detection circuit 7, the voltage comparator EL, the gate circuits 13 and 14 and the AND circuit 15 constitute an EOL detection circuit, and the frequency control circuit 5 and the driving circuit 6 constitute an EOL protection circuit. The frequency control circuit 5, driving circuit 6, voltage comparator EL, gate circuits 13 and 14, AND circuit 15 and pulse signal output circuit 12 also constitute the control circuit 4.

The first embodiment is configured to detect a DC voltage component in a period longer than a period in which a DC voltage component is increased temporarily, thereby allowing reduction of false detection of the DC voltage component generated in changing the dimming level, but EOL detection occurs if 4 a low output of the pulse signal coincides with a time at which the DC voltage component is generated. The present embodiment therefore employs the following method to further reduce errors in lamp EOL detection.

Figure 4:
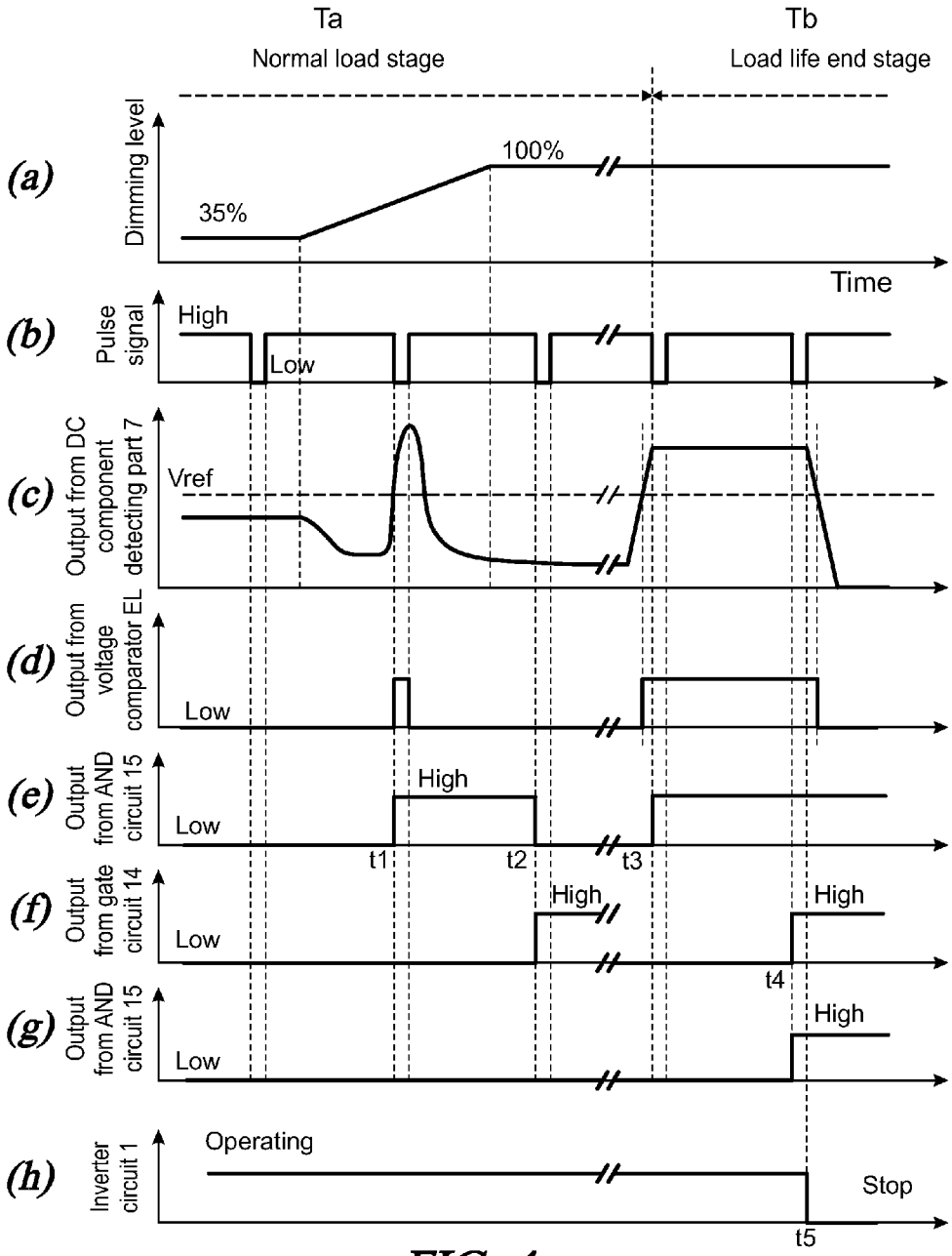
FIG. 4 is a signal timing chart according to the embodiment of FIG. 3.

FIG. 4 shows an output waveform in each of the ballast sub-circuit circuits in changing a dimming level in a normal lamp state (i.e. section Ta in FIG. 4) and an output waveform in each of the circuits in the lamp life end stage (i.e. section Tb in FIG. 4). Section (a) shows a dimming level, (b) shows a pulse signal of the pulse signal output circuit 12, (c) shows a value detected in the DC component detection circuit 7, (d) shows a value outputted from the voltage comparator EL, (e) shows a value outputted from the gate circuit 13, (f) shows a value outputted from the gate circuit 14, (g) shows a value outputted from the AND circuit 15, and (h) shows an operating state of the inverter circuit 1.

In the normal lamp state Ta, in response to a DC voltage component detected in accordance with a dimming operation at the point of time t1 (refer to (c)), the voltage comparator EL outputs a high signal (d). Then, the gate circuit 13 outputs a high signal (e) while the gate circuit 14 outputs a low signal (f), whereby the AND circuit 15 outputs a low signal (g), and the inverter circuit 1 continuously operates as a result (h). At time t2 in a subsequent detection period, the DC voltage component returns to a normal value so that the voltage comparator EL outputs a low signal. Then, a previous detection value is inputted to the gate circuit 14 which therefore outputs a high signal, while the gate circuit 13 outputs a low signal. Consequently, the AND circuit 15 outputs a low signal and the inverter circuit 1 continuously operates as a result.

Meanwhile, in the lamp EOL stat Tb, the voltage comparator EL outputs a high signal in response to the DC voltage component detected at time t3. Then, the gate circuit 13 outputs a high signal while the gate circuit 14 outputs a low signal. Therefore, the AND circuit 15 outputs a low signal and the inverter circuit 1 continuously operates as a result. At time t4 in a subsequent detection period, a continuously detected DC voltage component causes the voltage comparator EL to output a high signal. A detected value obtained at this time is then inputted to the gate circuit 13 which therefore outputs a high signal. A previously detected value is inputted to the gate circuit 14 which therefore outputs a high signal, so that the AND circuit 15 outputs a high signal and an output from the inverter circuit 1 is stopped at the point of time t5 as a result.

That is, the present embodiment is configured to output to the frequency control circuit 5, AND the output from the voltage comparator EL at this time and the output from the voltage comparator EL after one period of a pulse signal as stated above, whereby the output from the inverter circuit 1 is not reduced or stopped instantly even if a EOL detection occurs at this time for example. Then, in the case where the voltage comparator EL outputs the high signal after one period of a pulse signal (or in the case where an output from the DC component detection circuit 7 exceeds the reference voltage Vref again), an output from the inverter circuit 1 is reduced or stopped by the frequency control circuit 5 and the driving circuit 6, whereas the inverter circuit 1 continuously operates in the case where the voltage comparator EL outputs a low signal after one period of a pulse signal.

Accordingly, the present embodiment causes the AND circuit 15 to output an EOL detection signal in the case where an EOL state is detected twice in succession, enabling more accurate EOL detection and protection.

The present embodiment is also configured to increase the number of the gate circuits and obtain AND of values from all of them even in the case where a period of a pulse signal is set to be shorter than a period in which a DC voltage component is increased temporarily, thereby enabling further reduction in false EOL detection in the same manner.

Note that the above frequency control circuit 5, voltage comparator EL, driving circuit 10, pulse signal output circuit 12, gate circuits 13 and 14, and circuit 15 may also be replaced with a microcontroller in the same manner with the first embodiment. In this case, a configuration may be provided in such that an output from the inverter circuit 1 is reduced or stopped in the case where a read value is high twice in succession.

The present embodiment is also configured to reduce or stop an output from the inverter circuit 1 in the case where an output from the DC component detection circuit 7 exceeds the reference voltage Vref twice in succession, but it may also be configured to, for example, increase the number of the gate circuits to three or more and obtain AND of values from all of them. In this case, the end of the life of the discharge lamp FL can be similarly detected with higher accuracy than that of the first embodiment and false activation of the EOL protection circuit can be further reduced.

Figure 5:
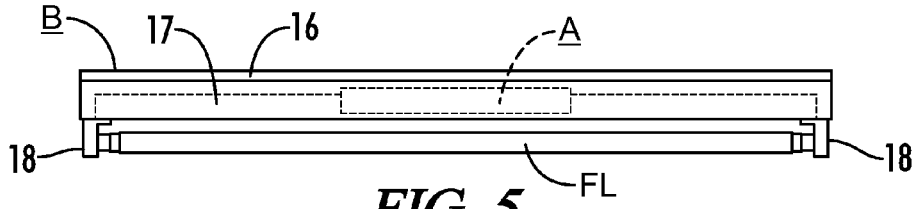
FIG. 5 is a side view of a discharge lamp fixture with an electronic ballast contained therein according to a third embodiment of the invention.
Figure 6:
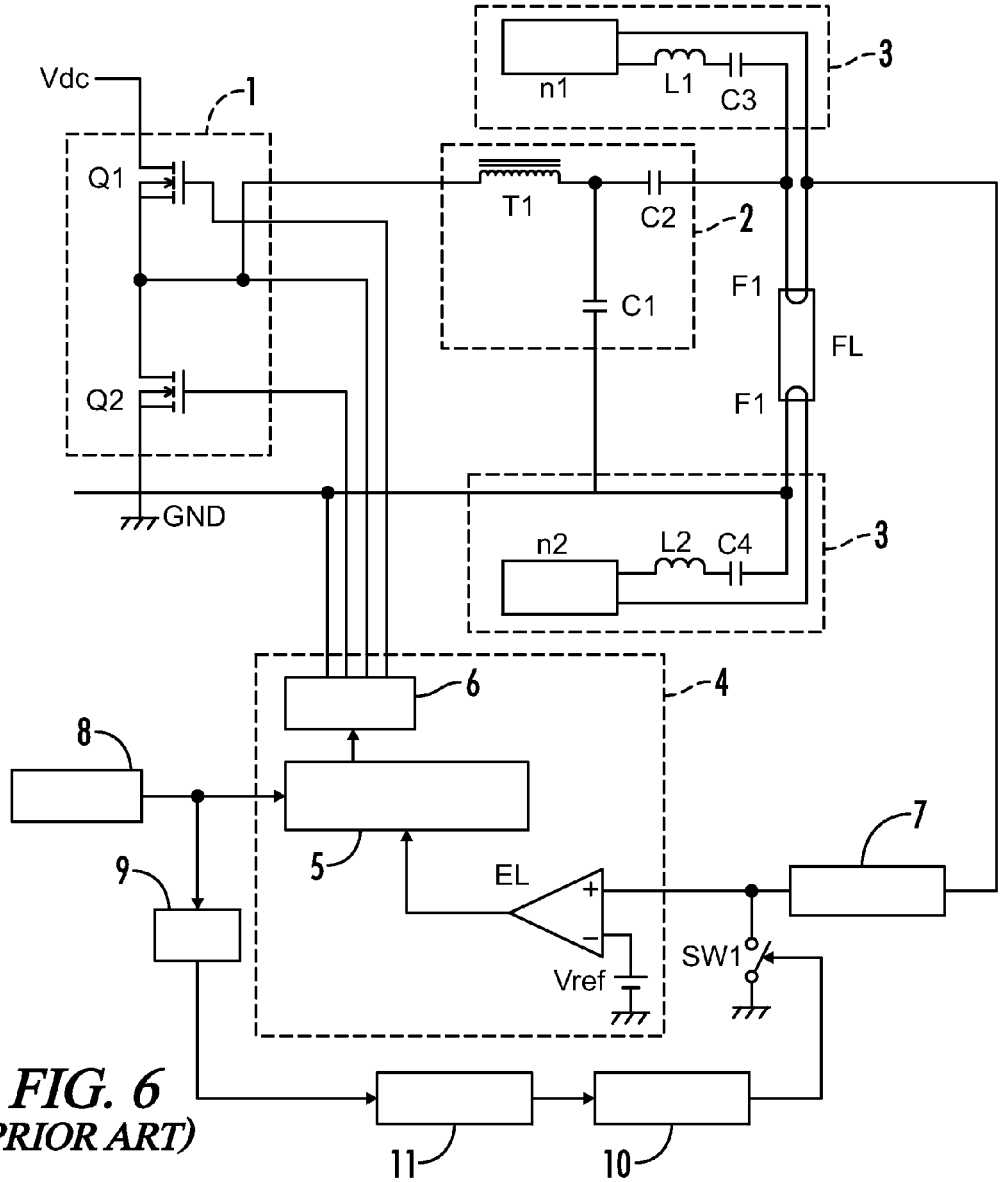
FIG. 6 (PRIOR ART)
FIG. 6 is a circuit diagram of a prior art electronic dimming ballast.
Figure 7:
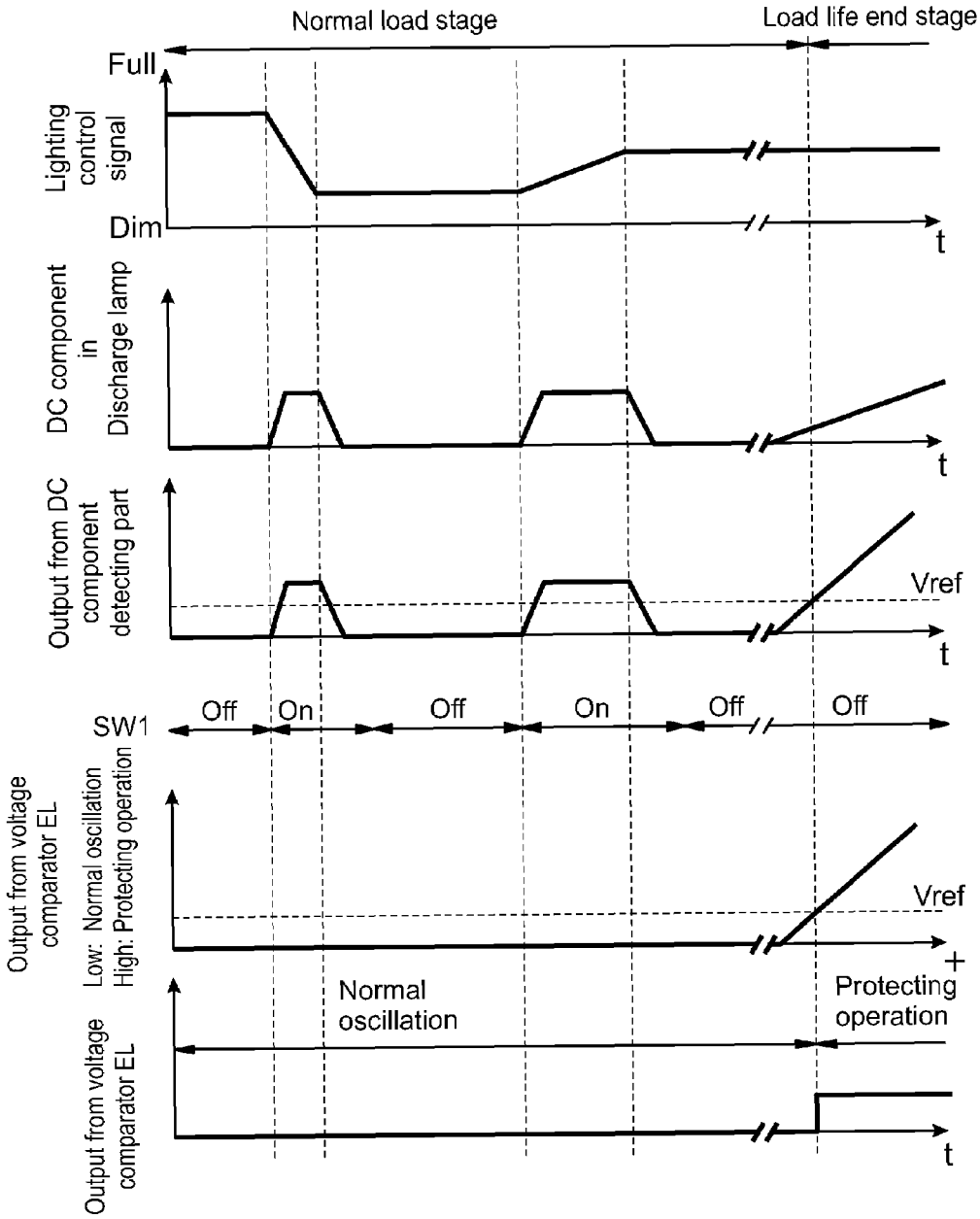
FIG. 7 is a signal timing chart according to the ballast of FIG. 6.

FIG. 5 shows a lamp fixture B according to a third embodiment, using the electronic ballast A as explained in the first and the second embodiments.

The lamp fixture B according to the present embodiment includes a fixture main body 16 extended in a lateral direction and containing lamp sockets 18, 18 arranged at both ends, and a cover 17 having a reflection plane on a bottom side and attached to the fixture main body 16. The electronic ballast A is stored inside the cover 17. The discharge lamp FL of a straight tube type is arranged between both of the lamp sockets 18, 18, and terminals arranged at both ends of the discharge lamp FL are electrically connected to the corresponding lamp sockets 18 respectively. Note that an output terminal (not shown) of the electronic ballast A and each of the lamp sockets 18 are electrically connected via an electric wire (not shown), and lighting power is supplied to the discharge lamp FL via the lamp sockets 18, 18.

Accordingly, the present embodiment makes it possible to provide the illumination fixture B capable of detecting the end of the life of the discharge lamp FL even in changing the dimming level by using the electronic ballast A explained in the first and the second embodiments, and realizing reduction of malfunction in the protection means.

Thus, although there have been described particular embodiments of the present invention of a new and useful Lamp End of Life Protection Circuit and Method for an Electronic Ballast, is not intended that such references be construed as limitations upon the scope of this invention except as set forth in the following claims.

What is claimed is:

1. An electronic ballast comprising:

an inverter circuit having at least one switching element and functional to convert a DC voltage into a high-frequency voltage;

a resonant circuit connected between outputs of the inverter circuit so as to light a discharge lamp at high frequency by a resonant action;

a preheating circuit connected to a filament of the discharge lamp and functional to preheat the filament;

a control circuit for controlling the inverter circuit to operate;

dimming circuit adapted to continuously change an output voltage to the discharge lamp by changing an operation frequency in the inverter circuit;

end of life detection circuit adapted to detect whether or not the discharge lamp is at the end stage of the life at every predetermined time and output a life end detection signal upon detection of a life end state;

protection circuit adapted to reduce or stop an output to the discharge lamp by controlling the switching element in response to a life end detecting signal inputted from the end of life detection circuit; and wherein the end of life detection circuit outputs the life end detection signal upon detection of a life end state at least twice in succession.

2. An illumination fixture comprising a fixture main body and the electronic ballast according to claim 1.

* * * * *